United States Patent [19]

Graden

[11] 4,138,062

[45] Feb. 6, 1979

[54] FURNACE AIR CIRCULATION SYSTEM

[76] Inventor: Lester E. Graden, 1218 Lawrence Ave., Leavenworth, Kans. 66048

[21] Appl. No.: 812,682

[22] Filed: Jul. 5, 1977

[51] Int. Cl.[2] ..... F24B 7/02; F24B 7/04

[52] U.S. Cl. ..... 237/55; 126/117; 165/DIG. 2

[58] Field of Search ..... 237/54, 55; 165/35, 165/39, DIG. 2, DIG. 12; 126/117

[56] References Cited

U.S. PATENT DOCUMENTS

| | | | |
|---|---|---|---|
| 1,059,600 | 4/1913 | Fisher | 237/55 |
| 2,252,784 | 8/1941 | Powers | 165/DIG. 2 X |
| 2,362,940 | 11/1944 | Skerritt | 165/39 |
| 2,479,413 | 8/1949 | Ryan | 165/DIG. 2 X |
| 2,879,976 | 3/1959 | Rose | 165/39 X |
| 2,890,866 | 6/1959 | Hansen | 165/39 X |
| 2,910,276 | 10/1959 | Escher | 165/154 X |
| 2,962,218 | 11/1960 | Dibert | 126/117 X |
| 3,009,643 | 11/1961 | Dibert | 126/110 R X |
| 4,050,627 | 9/1977 | Mayer | 165/35 X |

*Primary Examiner*—Thomas J. Holko
*Attorney, Agent, or Firm*—John A. Hamilton

[57] ABSTRACT

In connection with a furnace having a forced air recirculation system driven by a blower, and an atmospheric flue for its combustion chamber, a heat exchanger housing surrounding the flue to extract heat therefrom, the furnace blower drawing atmospheric air through the heat exchanger housing into the recirculating air system in proportions controlled either manually or automatically.

1 Claim, 3 Drawing Figures

FURNACE AIR CIRCULATION SYSTEM

This invention relates to new and useful improvements in home heating furnaces, and has particular reference to a new and novel furnace air circulating system. The overall object of the invention is the provision of such a system which improves the heat use efficiency of the furnace and also the comfort level of the heated zone.

More specifically, it is an object of the invention to reclaim and use much of the heat which is normally dissipated to atmosphere through the flue or chimney of the furnace.

Another object is the provision of a system of the general character described which permits the collection and storage of flue heat during periods of relatively low heat demand, for use in periods of relatively high demand for heat.

A further object is the provision of a system of the general character described which guarantees the continuous addition of at least a certain proportion of fresh atmospheric air to the recirculating air, thereby promoting greater comfort in the heated zone by avoiding the "stuffiness" resulting from oxygen deficiency occurring in recirculating masses of air in homes and other buildings.

A still further object is the provision of a system of the general character described including automatic controls whereby the heat extracted from the flue is adjusted to the maximum possible without interfering with its normal stack functions of providing adequate draft on the burner and disposing of the gaseous products of combustion.

Other objects are simplicity and economy of construction, and efficiency and dependability of operation.

Figure 1:
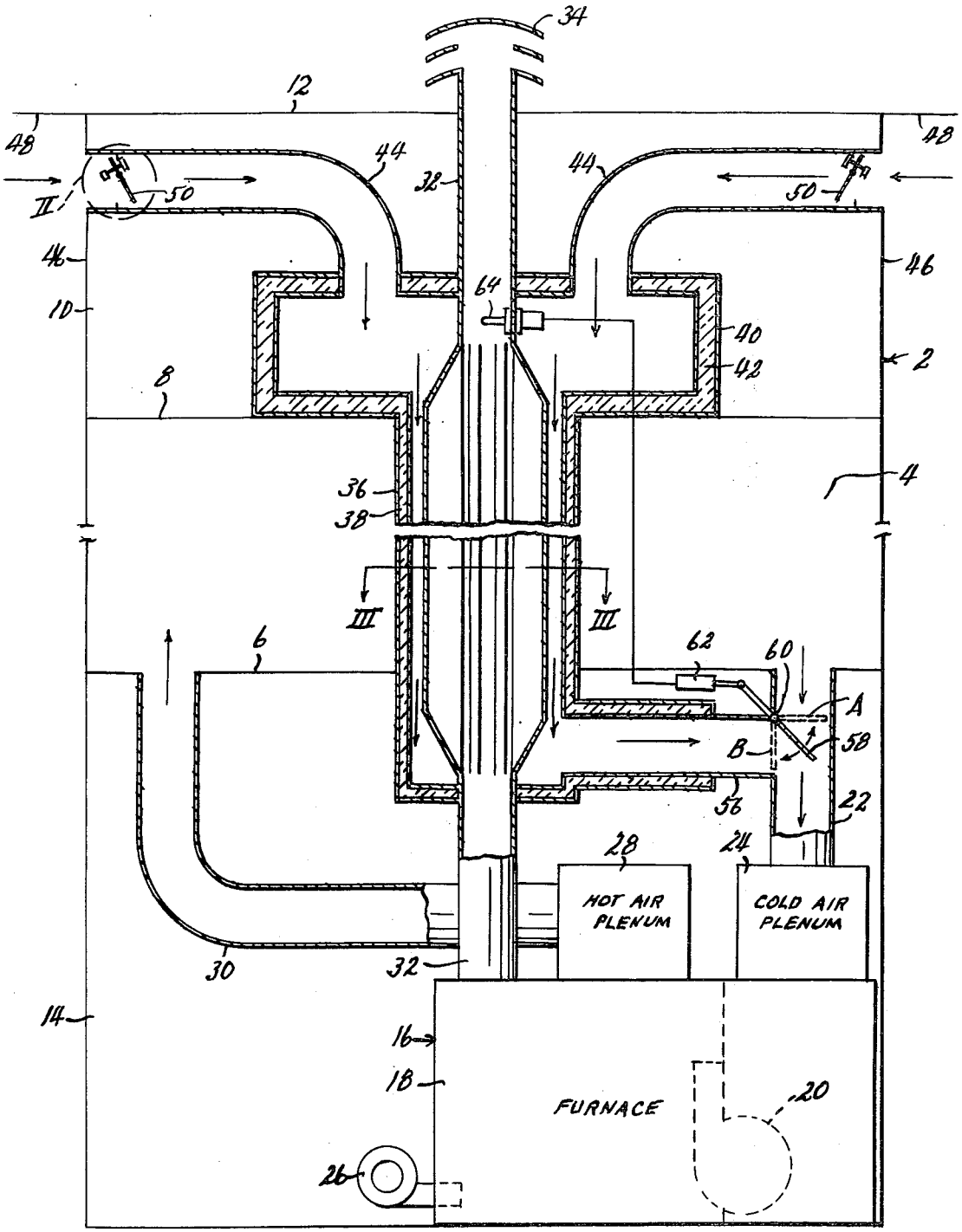
Figure 2:
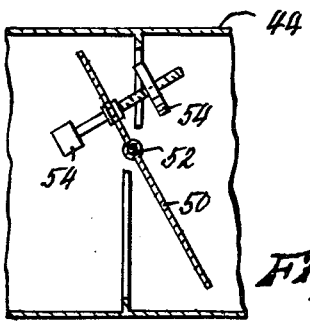
Figure 3:
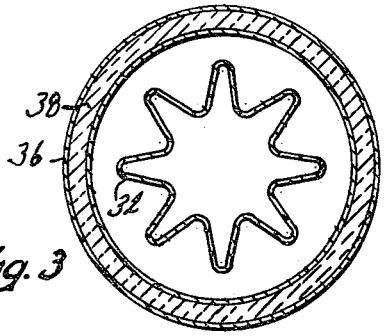

With these objects in view, as well as other objects which will appear in the course of the specification, reference will be had to the accompanying drawing, wherein:

FIG. 1 is a largely schematic diagram of a furnace air circulation system embodying the present invention, FIG. 2 is an enlarged detail view of the portion of FIG. 1 enclosed in circle II thereof, and FIG. 3 is an enlarged sectional view taken on line III—III of FIG. 1.

Like reference numerals apply to similar parts throughout the several views, and the numeral 2 applies generally to a diagrammatic showing of a house or other building including a living zone 4 having a floor 6 and a ceiling 8, attic space 10 above the ceiling and below roof 12, and basement space 14 below floor 6. Disposed in basement 14 is a furnace 16 of the gas-fired, forced-draft type including a housing 18 in which is mounted an electrically driven blower 20 operable to draw air from living zone 4 of the house through a ductwork system, here represented by a single duct 22 to the cold air plenum chamber 24 of the furnace, and delivered thereby to flow over and be heated by heat exchanger walls, not shown, heated by a gas burner 26, the heated air then passing from housing 18 through a hot air plenum chamber 28 and a ductwork system, here represented by a single duct 30, back to the living zone 4. This general pattern of furnace air flow is of course common and well known in the furnace art. The furnace of course includes a combustion chamber, not shown, in which the combustion of the fuel introduced by burner 26 is completed, and the hot, gaseous products of combustion move from the combustion chamber through a generally vertical flue pipe 32, said flue pipe extending upwardly through floor 6, living zone 4, ceiling 8, attic space 10, and roof 12, and being provided at its upper end with an atmospheric vent 34 which is suitably hooded to prevent the entry of rain or other atmospheric moisture.

The flue 32 performs the usual stack functions of providing a draft for sucking adequate supplies of secondary combustion air into the furnace combustion chamber, and of disposing of the gaseous products of combustion. These functions of course require an elevated temperature in the stack, but in most installations the stack temperature rises to such a high level, and so much heat escapes to the atmosphere through the stack without performing any useful function, as to constitute a direct wastage of a significant proportion of the total heat content of the fuel consumed. The elimination of much of this fuel waste is the overall object of the present invention.

According to the present invention, flue pipe 32, along as great a portion of its length as may be practically possible, is surrounded concentrically by a larger jacket pipe 36 the wall of which is thermally insulated as indicated at 38. Pipe 36 extends vertically through the living zone 4, and into attic space 12 and basement space 14. At its upper end, it opens into a heat storage compartment 40, the walls of which are also insulated as indicated at 42, and which is disposed in attic space 10. The compartment should be as large as is practically possible in order to be capable of storing the greatest possible amount of heat when desired, as will be described.

Connected into the top of compartment 40 are one or more (two shown) conduits 44 each opening to the atmosphere through an exterior wall 46 of house 2, preferably beneath an overhanging eave 48. Adjacent its outer end, each conduit 44 is fitted with a damper door 50 which, as best shown in FIG. 2, is pivoted above its center in the conduit, as at 52, whereby to be biased by gravity to a closed position, but which may be pivoted to an open position, as illustrated, by a draft against its outer surface. It is provided with adjustable counterweights 54 to vary the degree to which it will be opened, and hence the rate at which air will be admitted to the conduit, for any given degree of vacuum which may be established within the conduit. Such draft regulating dampers are of course common and well known.

Within pipe 36, flue pipe 32 is preferably longitudinally finned or fluted as shown in FIG. 3 to improve heat transfer therebetween. The lower end of pipe 36, within basement space 14, is interconnected by conduit 56 into the cold air return conduit 22 which interconnects living zone 4 with the cold air plenum 24 of the furnace. The walls of conduit 56 may also be insulated as shown. Thus whenever blower 20 is actuated, it tends to draw air into cold air plenum 24 both from living zone 4, and also fresh atmospheric air through conduits 44, compartment 40, pipe 36 and conduit 56. The proportions of the air arriving at the furnace from these two sources are governed by a damper 58 disposed at the juncture of conduits 22 and 56, and adjustably pivoted at 60. Normally, the position of said damper is regulated by a control device 62 which is responsive to a temperature-sensitive device 64 disposed in flue pipe 32 adjacent the upper end of jacket pipe 36. The specific function of these controls will be described below in greater detail. It will be understood, however, that damper 58 also may be disconnected from control device 62, and positioned manually either in a position A in which it forces the furnace to draw nearly its entire supply of air from conduit 56, or in a position B in which it forces the furnace to draw nearly its entire supply of air from living zone 4.

In operation, it will be understood that the usual control system of the furnace, not shown but usually thermostatic in nature, turns on burner 26 whenever living zone 4 calls for heat, and after a start-up period of burner operation sufficient to provide that air emerging from hot air plenum chamber 28 will be properly heated, blower 20 is actuated, usually by a temperature-sensitive stack switch in the flue. These controls are standard and are not here shown. Air heat by the furnace is thus delivered through conduit 30 to the living zone until the thermostat setting of the living zone is satisfied, at which time the burner is shut off by the thermostat and after a time lapse in which continued operation of the blower cools the furnace, the blower is shut off by the stack switch. Whenever the burner is in operation, large quantities of the gaseous products of the burner combustion pass upwardly through flue pipe 32, and said pipe becomes very hot. While the flue temperature must be elevated in order to perform the usual stack functions of disposing of the combustion products and maintaining a proper draft on the burner, the flue in an ordinary system usually becomes far hotter than is necessary for these purposes, with the result that a substantial amount of the heat passing up the flue represents a pure waste of a significant proportion of the total heat content of the fuel consumed. The minimum required flue temperature for any given installation is a substantially constant figure.

In the present system, when damper 58 is being regulated by control device 62 and temperature sensor 64, as would normally be the case, it will be seen that whenever blower 20 is actuated as already described, it creates a partial vacuum in cold air plenum 24, which draws air from living zone 4 through conduit 22, and also causes automatic draft control dampers 50 to open to allow atmospheric air to enter conduits 44 and pass downwardly through heat storage chamber 40 and pipes 36 and 56 to conduit 22 and to the furnace, the fresh air and recirculated air being divided in proportions determined by the setting of damper 58. The fresh air is heated by its contact with heated flue pipe 32 within jacket pipe 36, and is thus pre-heated before it reaches the furnace. Thus the system performs its primary function of reclaiming heat which otherwise would have been dissipated up the flue, and hence promotes greater fuel efficiency. The proportion of fresh and recirculated air entering the furnace is determined by damper 58, as regulated by controls 62 and 64, and these controls are so set as to maintain the minimum flue temperature required for the flue to perform its stack functions of providing for burner draft and disposal of combustion products. That is, as the flue is cooled by circulation of fresh air in jacket 36, the controls move damper 58 toward its B position, reducing the volume of fresh air moving through jacket 36, until a condition of balance is reached in which said volume is constant, and just sufficient to cool the flue to its minimum required temperature, but to no lower temperature. The counter-weights 54 of dampers 50 may be adjusted to vary the draft required to open them, in order to maintain the air flow rate in jacket 36 within a range properly controllable by damper 58. This is necessary since damper 58 is preferably of a type which permits the flow of at least a minimum volume of air thereby even when it is positioned in either of its extreme A or B positions. In the A position, this "leakage" of damper 58 guarantees at least a minimum circulation of air in living zone 4, and in the B position it guarantees the constant introduction of at least a minimum amount of fresh air into the system. The setting of dampers 50 is dictated by the air delivery capacity of blower 20, and hence usually needs to be made only once for each installation.

While damper 58 would seldom if ever be in either of its extreme A or B positions while being automatically regulated by controls 62 and 64, it may as already mentioned be manually adjusted. When set in the B position, there will be very little air circulating in jacket 36, only the minimum amount allowed by the "leakage" of the damper to guarantee the continuous addition to the system of a minimum proportion of fresh air, and hence there will be little cooling effect on the flue pipe. Therefore air will circulate in the jacket and in heat storage compartment 40 by normal convection currents, and gradually be heated to a high temperature, dampers 50 of course being closed, or nearly so, at this time. This setting of damper 58 would ordinarily be made in periods of low heat demand on the system, and depending on the volume of compartment 40, allows the storage of quite substantial quantities of heat. This stored heat may then be reclaimed for use in heating the house by setting damper 58 at position A for a period of time, thus drawing large quantities of air from compartment 40 through jacket 36 and a correspondingly low volume of air from living zone 4. This setting may be used to help supply the large quantity of heat necessary at the start of a sudden cold spell.

Conduits 44 are not necessarily connected to atmosphere through the building walls, as shown, it being necessary only that they be connected into a source of air to be heated. They could, for example, be connected into living zone 4, preferably in the lower regions thereof, whereby the air circulated in jacket 36 would not be fresh, but recirculated air. Otherwise, operation of the system would remain the same, still functioning to reclaim heat which would otherwise be dissipated up the flue. However, the continuous admission of fresh air to the system is preferred in order to offset the "airless" or "stuffy" condition often associated with recirculating type furnaces.

While I have shown and described a specific embodiment of my invention, it will be readily apparent that many minor changes of structure and operation could be made without departing from the spirit of the invention.

What I claim as new and desire to protect by Letters Patent is:

1. In combination with a furnace including a blower operable to extract air from a zone to be heated and to return said air to said zone, and a fuel burner operable to heat said air as it passes through said furnace, said burner having a vertically extending flue pipe having stack functions including the disposal of the gaseous products of combustion of said burner and the maintenance of a draft on said burner, an air circulation system comprising:

a. an air jacket surrounding a substantial portion of the length of said flue pipe, and having air inlet and outlet openings adjacent the respectively opposite ends thereof, b. first conduits interconnecting the inlet opening of said jacket with a source of air to be heated by said furnace, c. a second conduit interconnecting the outlet opening of said jacket with the air inlet of said furnace, whereby said blower draws air into said furnace partially from said zone to be heated, and partially from said jacket, the air being drawn from said jacket being warmed by heat transferred thereto through the walls of said flue pipe, the furnace air intake from the zone to be heated, and said second conduit from the air outlet of said jacket, converging in a common conduit connected to the air inlet of said furnace, d. a damper disposed at said point of conduit convergence and being adjustable to vary the relative proportions of the air entering the furnace which are drawn respectively from said heated zone and from said jacket, e. automatic temperature-responsive means operable responsively to the gas temperature within said flue pipe to regulate said damper to throttle the flow of air through said jacket sufficiently to allow said flue temperature to remain sufficiently high that said flue may perform its stack functions, said automatically controlled damper always being partially open even at the extremes of its controlled movement, not completely disconnecting the furnace air intake either from the heated zone or from said jacket, and f. a normally closed additional damper disposed in each of said first conduits and operable to open responsively to draft generated by actuation of said furnace blower, each of said last-named additional dampers being equipped with means operable to adjust the degree of draft required to open said damper.

* * * * *